US007293322B2

(12) United States Patent
Matousek et al.

(10) Patent No.: US 7,293,322 B2
(45) **Date of Patent: *Nov. 13, 2007**

(54) CLEANING ATTACHMENT FOR VACUUM CLEANER

(75) Inventors: Robert A. Matousek, Lakewood, OH (US); Craig M. Saunders, Rocky River, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 596 days.

This patent is subject to a terminal disclaimer.

(21) Appl. No.: 10/681,965

(22) Filed: Oct. 9, 2003

(65) Prior Publication Data

US 2005/0076468 A1 Apr. 14, 2005

(51) Int. Cl.
*A47L 5/26* (2006.01)
*A47L 5/30* (2006.01)
*A47L 9/04* (2006.01)

(52) U.S. Cl. ..... 15/320; 15/328; 15/344; 15/403

(58) Field of Classification Search ..... 15/320, 15/328, 344, 363, 393, 403, DIG. 1
See application file for complete search history.

(56) References Cited

U.S. PATENT DOCUMENTS

| | | | |
|---|---|---|---|
| 1,657,111 | A | 1/1928 | Desnoyers |
| 1,978,579 | A | 10/1934 | Hooks |
| 2,012,287 | A | 8/1935 | Replogle et al. |
| 2,064,903 | A | 12/1936 | Ghignatti |
| 2,091,290 | A | 8/1937 | Replogle |
| 2,564,339 | A | 8/1951 | Nerheim |
| 2,821,733 | A | 2/1958 | Kasper |
| 2,873,465 | A | 2/1959 | Miller |
| 2,893,048 | A | 7/1959 | Martinec |
| 3,833,962 | A | 9/1974 | Krusche |
| 4,172,710 | A | 10/1979 | van der Molen |
| 4,266,317 | A | 5/1981 | Duda |
| 4,665,582 | A | 5/1987 | Richmond et al. |
| 4,802,782 | A | 2/1989 | Scalf |
| 4,833,752 | A | 5/1989 | Merrick |
| 5,020,186 | A | 6/1991 | Lessig, III et al. |
| 5,060,342 | A | 10/1991 | Brazier |
| 5,074,008 | A | 12/1991 | Palomino, Jr. |
| 5,107,567 | A | 4/1992 | Ferrari et al. |
| 5,167,045 | A | 12/1992 | Rodriguez |

(Continued)

FOREIGN PATENT DOCUMENTS

DE 297 04 742 U 10/1997

(Continued)

OTHER PUBLICATIONS

Patent Abstracts of Japan, vol. 1998, No. 13, Nov. 10, 1998 & JP 10 201697 A (Mizuno Akira; Nitto Denko Corp), Aug. 4, 1998.

*Primary Examiner*—David Redding
(74) *Attorney, Agent, or Firm*—Fay Sharpe LLP

(57) ABSTRACT

An attachment for use with a vacuum cleaner, includes a suction nozzle, a conduit communicating the nozzle with the vacuum cleaner, and a support plate. A pivot joint connects the support plate to the suction nozzle. A cleaning sheet is selectively attached to the support plate for collecting dust and dirt to be cleaned.

29 Claims, 10 Drawing Sheets

U.S. PATENT DOCUMENTS

| | | | |
|---|---|---|---|
| D338,705 | S | 8/1993 | Spokoiny |
| 5,392,491 | A | 2/1995 | Hwang et al. |
| 5,399,381 | A | 3/1995 | Randall |
| 5,557,823 | A | 9/1996 | Rouda |
| 5,603,139 | A | 2/1997 | Alazet |
| 5,659,922 | A | 8/1997 | Louis |
| 5,713,103 | A | 2/1998 | Keebler et al. |
| 5,779,745 | A | 7/1998 | Kilstrom |
| 5,888,006 | A | 3/1999 | Ping et al. |
| D409,343 | S | 5/1999 | Kingry et al. |
| 5,909,755 | A | 6/1999 | Leal |
| 5,960,508 | A | 10/1999 | Holt et al. |
| 5,988,920 | A | 11/1999 | Kunkler et al. |
| 6,003,191 | A | 12/1999 | Sherry et al. |
| 6,017,163 | A | 1/2000 | Keppers et al. |
| D420,561 | S | 2/2000 | Kunkler |
| D423,742 | S | 4/2000 | Kingry et al. |
| 6,045,622 | A | 4/2000 | Holt et al. |
| 6,048,123 | A | 4/2000 | Holt et al. |
| 6,065,182 | A | 5/2000 | Wright et al. |
| 6,101,661 | A | 8/2000 | Policicchio et al. |
| 6,101,668 | A | 8/2000 | Grey |
| 6,142,750 | A | 11/2000 | Benecke |
| 6,146,434 | A | 11/2000 | Scalfani et al. |
| 6,243,909 | B1 | 6/2001 | Graham et al. |
| 6,243,912 | B1 | 6/2001 | Grey |
| 6,305,046 | B1 | 10/2001 | Kingry et al. |
| 6,328,543 | B1 | 12/2001 | Benecke |
| 6,334,233 | B1 | 1/2002 | Roberts et al. |
| 6,347,428 | B1 | 2/2002 | Shimko et al. |
| 6,353,964 | B1 | 3/2002 | Andrisin, Jr. et al. |
| 6,380,151 | B1 | 4/2002 | Masters et al. |
| 6,386,392 | B1 | 5/2002 | Argentieri et al. |
| D458,427 | S | 6/2002 | Kunkler et al. |
| 6,474,896 | B1 | 11/2002 | DeLaine, Jr. |
| 6,629,332 | B2 * | 10/2003 | Morgan et al. ..... 15/320 |
| D487,324 | S | 3/2004 | Santiago et al. |
| 2001/0047559 | A1 | 12/2001 | Graham et al. |
| 2002/0042962 | A1 | 4/2002 | Willman et al. |
| 2002/0050016 | A1 | 5/2002 | Willman et al. |
| 2002/0066153 | A1 | 6/2002 | Sclafani et al. |
| 2004/0031121 | A1 | 2/2004 | Martin et al. |
| 2004/0045126 | A1 | 3/2004 | Parker et al. |

FOREIGN PATENT DOCUMENTS

| | | | |
|---|---|---|---|
| DE | 201 03 268 | U1 | 6/2001 |
| EP | 0 370 698 | A1 | 5/1990 |
| EP | 0 625 331 | B1 | 8/1997 |
| EP | 1 027 855 | A2 | 8/2000 |
| GB | 741 136 | A | 11/1955 |
| GB | 2 078 496 | A | 6/1981 |
| GB | 2376874 | * | 12/2002 |
| WO | WO 98/23200 | | 6/1998 |
| WO | WO 01/72195 | A1 | 10/2001 |

* cited by examiner

CLEANING ATTACHMENT FOR VACUUM CLEANER

FIELD OF THE INVENTION

The present invention relates to vacuum cleaners. More particularly, the present invention relates to a cleaning attachment having a removable cleaning sheet which is used with a vacuum cleaner such as a canister or upright vacuum cleaner.

BACKGROUND OF THE INVENTION

Upright vacuum cleaners are ubiquitous. They are known to include an upper portion having a handle, by which an operator of the vacuum cleaner may grasp and maneuver the cleaner, and a lower cleaning nozzle portion which travels across a floor, carpet, or other surfaces being cleaned. The upper portion is often formed as a rigid plastic housing which encloses a dirt and dust collecting filter receptacle, such as a dirt cup or filter bag. Alternatively, the upper portion may simply be an elongated handle with the filter bag, and an external cloth bag, being hung therefrom. The cleaning or suction nozzle is hingedly connected to the upper handle portion such that the upper portion is pivotable between a generally vertical upright storage position and an inclined operative position. The underside of the nozzle includes a suction opening which is in fluid communication with the dirt cup or filter bag.

A vacuum or suction source such as a motor and fan assembly is enclosed either within the nozzle portion or the upper portion of the cleaner. The vacuum source generates the suction required to pull dirt from the carpet and floor being vacuumed through the suction opening and into the filter bag or dirt cup. A rotating brush assembly is typically provided in proximity to the suction opening to loosen dirt and debris from the surface being vacuumed.

As with any other vacuum cleaner, dirt-laden air is drawn into an upright vacuum cleaner through a nozzle by a suction that is created by a suction motor driving a suction fan or impeller. The dirt-laden air passes into a dirt collection receptacle such as a dirt cup or filter bag. The dirt is held in the receptacle and the air is exhausted.

An alternative to the upright vacuum cleaner is the canister vacuum cleaner. Canister vacuum cleaners typically employ a suction nozzle or tool, connected to the body of the canister by a hose, for suctioning dirt and debris from carpets, floors, and above floor surfaces. Both the suction source and the dirt collecting receptacle are in the canister. The suction nozzle can be provided with a rotating brush assembly, if desired.

Canister vacuum cleaners are particularly popular in Europe for cleaning a variety of surfaces in homes, offices, cars or the like. Like upright vacuum cleaners, canisters typically utilize attachments, in addition to the normal suction nozzle, for particularly cleaning in hard to reach places. Both types of vacuum cleaner units typically use a variety of attachments or tools with suction nozzles to reach hard to reach areas, on stairways, in cars, etc.

Of course, non-powered cleaning implements are also widely known. They are used for removing dust, dirt and/or liquids from hard surfaces. Brooms are one example. More recently, a cleaning implement which comprises a handle and a cleaning pad with a removable cleaning sheet has become popular for cleaning dry surfaces. The cleaning sheets exhibit the ability to pick up dust and debris from the surface to be cleaned. Once dirty, the sheet is discarded and replaced with a clean one. One such product is sold by Procter & Gamble under the trademark SWIFFER™.

This product uses non-woven sheets for dry dust-type cleaning. Such sheets typically utilize a composite of fibers where the fibers are bonded by adhesive, or are entangled in other ways. See for example U.S. Pat. Nos. 3,629,047 and 5,144,729. To provide durable wiping sheets, reinforcement means are combined with staple fibers in the form of continuous filament or network structure. Such cleaning sheets maximize the surface of the sheet and have electrostatic properties for collecting and/or attracting particulate dirt.

However, cleaning implements that comprise a removable cleaning sheet are not able to successfully remove larger debris or particles from the surface to be cleaned. Such debris may include animal hair or fur, dirt, sand or small pebbles brought in from outdoors, food crumbs or other larger particles of debris.

It would be desirable to combine a removable cleaning sheet from a cleaning implement with a suction tool of an upright vacuum cleaner or a canister vacuum cleaner. This could be accomplished by providing a suction tool, having a removable cleaning sheet attached thereto, as an attachment to a vacuum cleaner.

Accordingly, it is desirable to develop a new and improved cleaning product which would overcome the foregoing difficulties and others and meet the above stated need for an attachment with a cleaning sheet in combination with a suction tool for a vacuum cleaner.

SUMMARY OF THE INVENTION

The present invention relates to a vacuum cleaner. In particular, the present invention relates to an attachment or suction tool having a removable cleaning sheet used with a vacuum cleaner such as upright vacuum cleaner or a canister vacuum cleaner.

In accordance with one aspect of the invention, an attachment for use with a vacuum cleaner has a suction nozzle, a conduit communicating the nozzle with the vacuum cleaner, a support plate and a pivot joint connecting the support plate to the suction nozzle. A cleaning sheet is selectively attached to the support plate for collecting dust and dirt to be cleaned.

In accordance with another aspect of the invention, a vacuum cleaner has a housing, a suction fan and motor mounted to the housing, and a dirt collecting receptacle mounted to the housing in spaced relationship to the suction fan and motor. The attachment has a suction nozzle and a support plate connected to the nozzle which selectively holds a cleaning sheet for collecting dirt and debris from a surface to be cleaned. A conduit communicates the suction nozzle to the housing.

In accordance with yet another aspect of the invention, an attachment for use with a vacuum cleaner has a suction nozzle and a conduit having a first end and a second end, where the conduit first end is connected to the suction nozzle and the conduit second end is connected to a filter chamber in an associated vacuum cleaner. A pivot joint connects the support plate to the suction nozzle. A cleaning sheet is removably attached to the support plate to collect dirt and dust from a surface to be cleaned.

Other aspects of the invention will become apparent to those skilled in the art upon a reading and understanding of the following detailed description.

BRIEF DESCRIPTION OF THE DRAWINGS

The invention may take form in certain components and structures, several preferred embodiments of which will be illustrated in the accompanying drawings wherein.

DETAILED DESCRIPTION OF THE EMBODIMENTS

Figure 1:
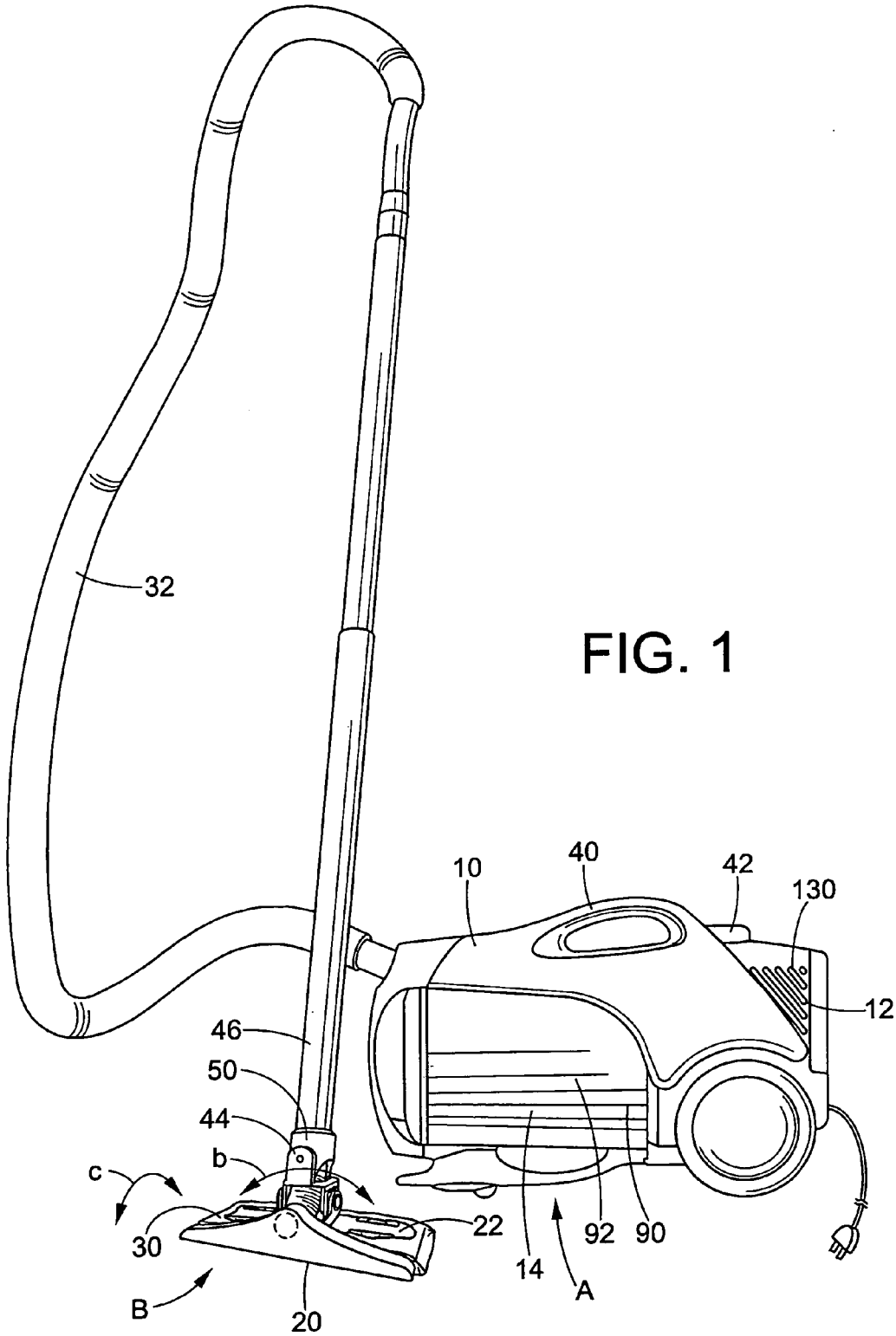
FIG. 1 is a perspective view of a canister vacuum cleaner having a suction tool attached thereto according to a first embodiment of the present invention.

Referring now to the drawings, wherein the showings are for purposes of illustrating several preferred embodiments of this invention only and not for purposes of limiting same, FIG. 1 shows a vacuum cleaner A according to a first embodiment of the present invention.

The vacuum cleaner A is illustrated to be of the canister-type and includes a housing 10, a suction fan and motor assembly 12 which is mounted to the housing, and a dirt collecting receptacle 14 which is also mounted to the housing, in a spaced relationship to the suction fan and motor assembly. A suction tool B to be used with the vacuum cleaner to pick up dirt and dust from a floor surface includes a nozzle body 20, and a support plate 22 which is connected to the nozzle. The support plate 22 selectively holds a disposable cleaning sheet 30 for collecting dust and debris from a surface to be- cleaned. A conduit 32, such as a flexible hose, communicates the nozzle body 20 with the housing.

The vacuum cleaner further includes a handle 40 which extends from the housing 10. The handle can be an integral part of the housing. A power switch 42 is located on the housing for selectively actuating the suction fan and motor assembly. The support plate or cleaning pad member 22 can be mounted to the suction tool by a pivotable joint, such as a conventional universal joint 44, which interconnects the suction tool with the support plate. As is well known, the universal joint allows the tool to pivot along two rotational axes "b" and "c" which are oriented perpendicular to each other.

Figure 2:
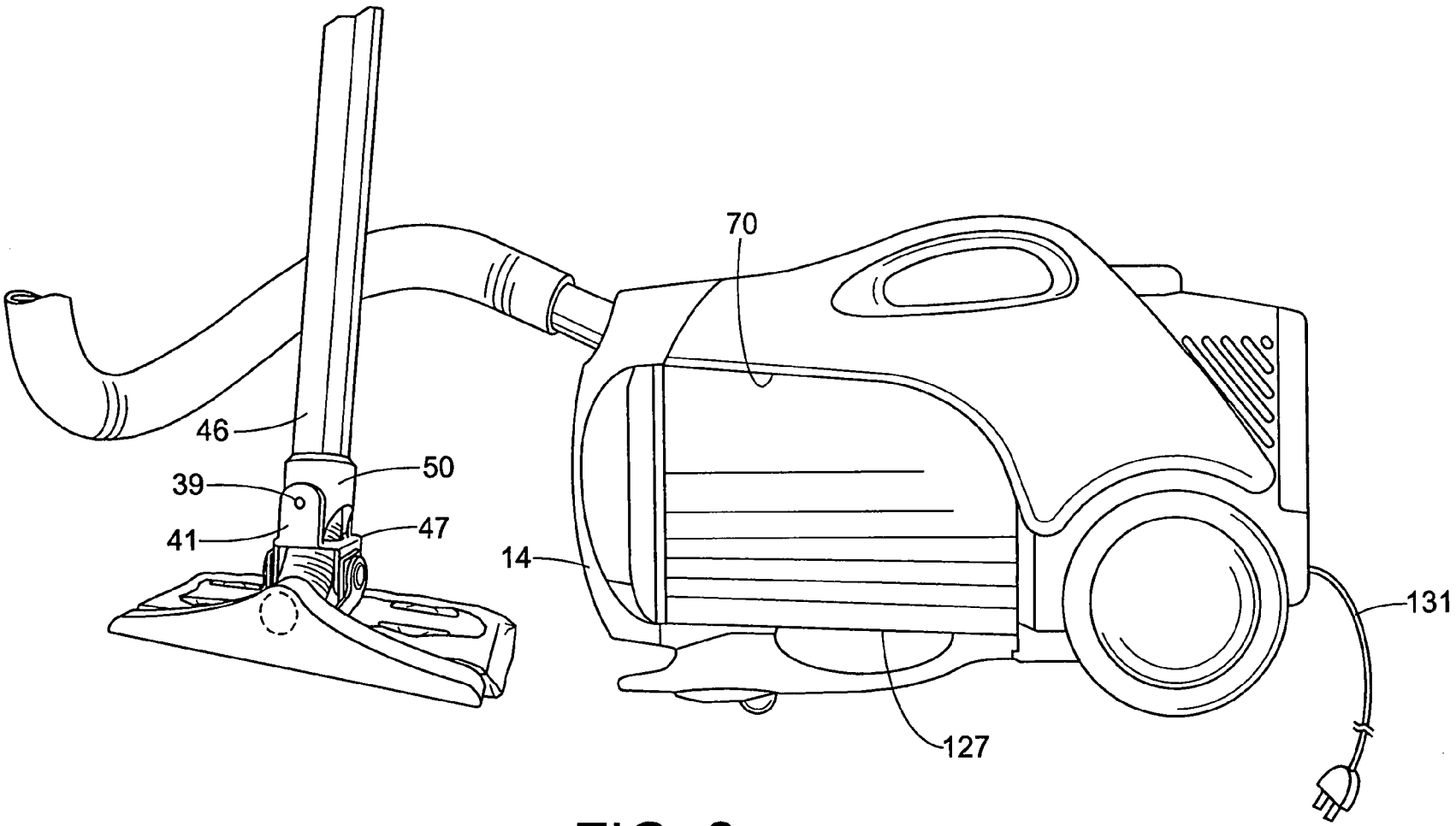
FIG. 2 is an enlarged perspective view of a lower portion of the vacuum cleaner of FIG. 1.

With reference now to FIG. 2, a wand 46 is telescopically received in a tube 50 which is mounted to a first fork 41 of the universal joint via pins 39 which extend through aligned holes in the tube and the fork 41 for pivotably mounting the tube to the universal joint.

Figure 3:
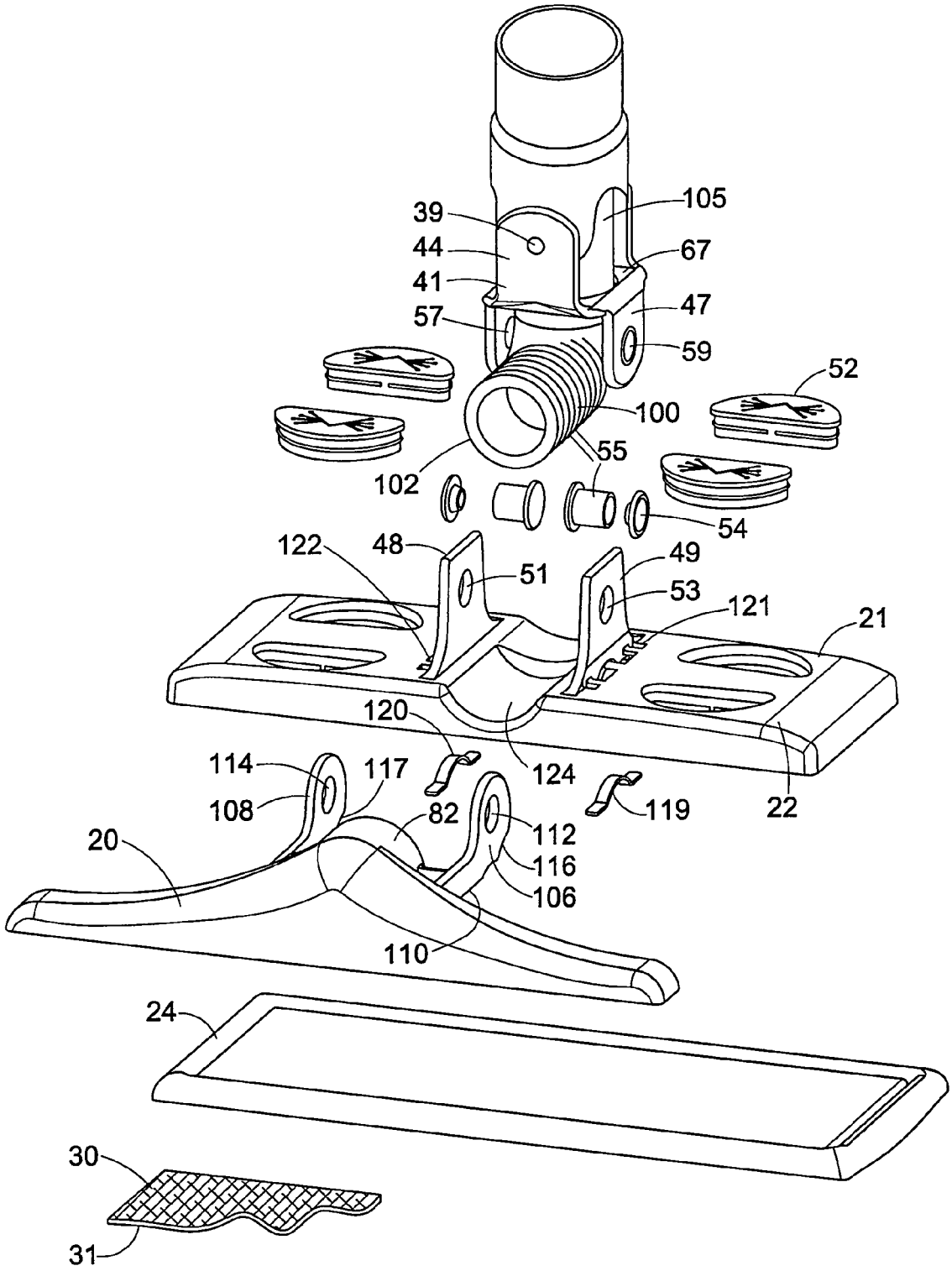
FIG. 3 is an enlarged exploded perspective view of the suction tool of the vacuum cleaner of FIG. 1.

Referring now to FIG. 3, the universal joint has a second fork 47 which is interconnected with the support plate 22 at spaced apart flanges 48, 49 of the support plate for pivotably securing the support plate to the suction tool. The second fork 47 has a rotational axis perpendicular to the axis of the first fork 41. Flanges 48, 49 are interconnected with fork 47 via dowel pins or plugs 55 which extend through holes 51, 53 of the connecting members and holes 57, 59 of the second rotational joint. Caps or seals 54 secure the pins 55 within the holes of the connecting members and fork 47. The two forks 41 and 47 can be secured to each other along a base plate 67 thereof by conventional means, such as gluing, welding or the like, depending on the material from which the forks are made. Alternatively, the entire joint member can be of one piece.

With continued reference to FIG. 3, the support plate 22 comprises a plurality of attachment structures or slitted attachment clips 52 which are configured to receive and retain the cleaning sheet 30 about the support plate during use. The clips can be of the type described in detail in U.S. Pat. No. 6,305,046, which is incorporated herein by reference in its entirety. The clips 52 can be disposed adjacent the corners of the support plate, although these locations can be varied depending upon the size and shape of the support plate. The disposable cleaning sheet 30 is thus releasably attached to the support plate using the clips 52.

Figure 4:
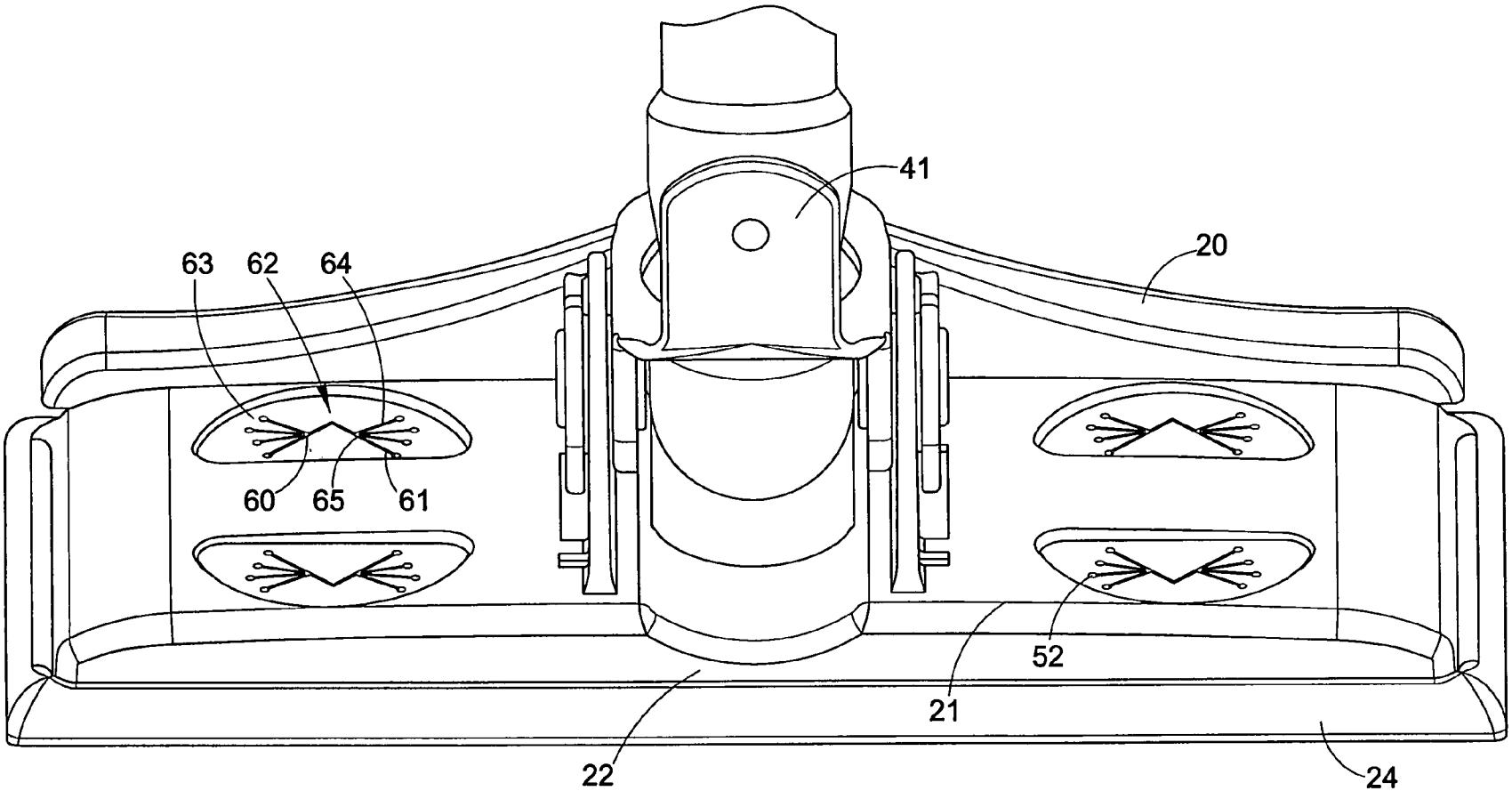
FIG. 4 is an enlarged assembled perspective view of the suction tool of FIG. 3.

As best seen in FIG. 4, the attachment structures can each comprise a base triangle 60 which is defined along two sides thereof by slits 61 which extend through the flexible material which forms the attachment structures. An apex 62 of the base triangle is formed by the intersection of the slits 61. The attachment structures further include a plurality of pie wedge-shaped sections 63 having apexes 64 which meet at a substantially common point 65. This arrangement permits the pie wedge-shaped sections to individually deflect relative to each other under finger pressure so that a portion of the sheet can be pushed through the top surface of the attachment structures and into a cavity (not shown) formed within the attachment structures.

As the sheet is pushed past the top surface of an attachment structure or clip 52, the apexes of the pie wedge-shaped sections and the apex of the base triangle can pierce and engage the sheet 30 such that the sheet is retained about the support plate during use. While clips 52 are shown for selectively attaching the cleaning sheet 30 to the support plate 22, it should be appreciated that a variety of other structures can be used for the same purpose. For example, cooperating hook and loop fasteners may be provided on the support plate and the sheet. Also, an elastic band could be secured around the periphery of the sheet. The band can be smaller in its normal state than the diameter of the support plate, thus allowing the sheet to be selectively secured to and detached from the support plate simply by enlarging the band to fit it, and the periphery of the cleaning sheet, over the support plate.

Figure 5:
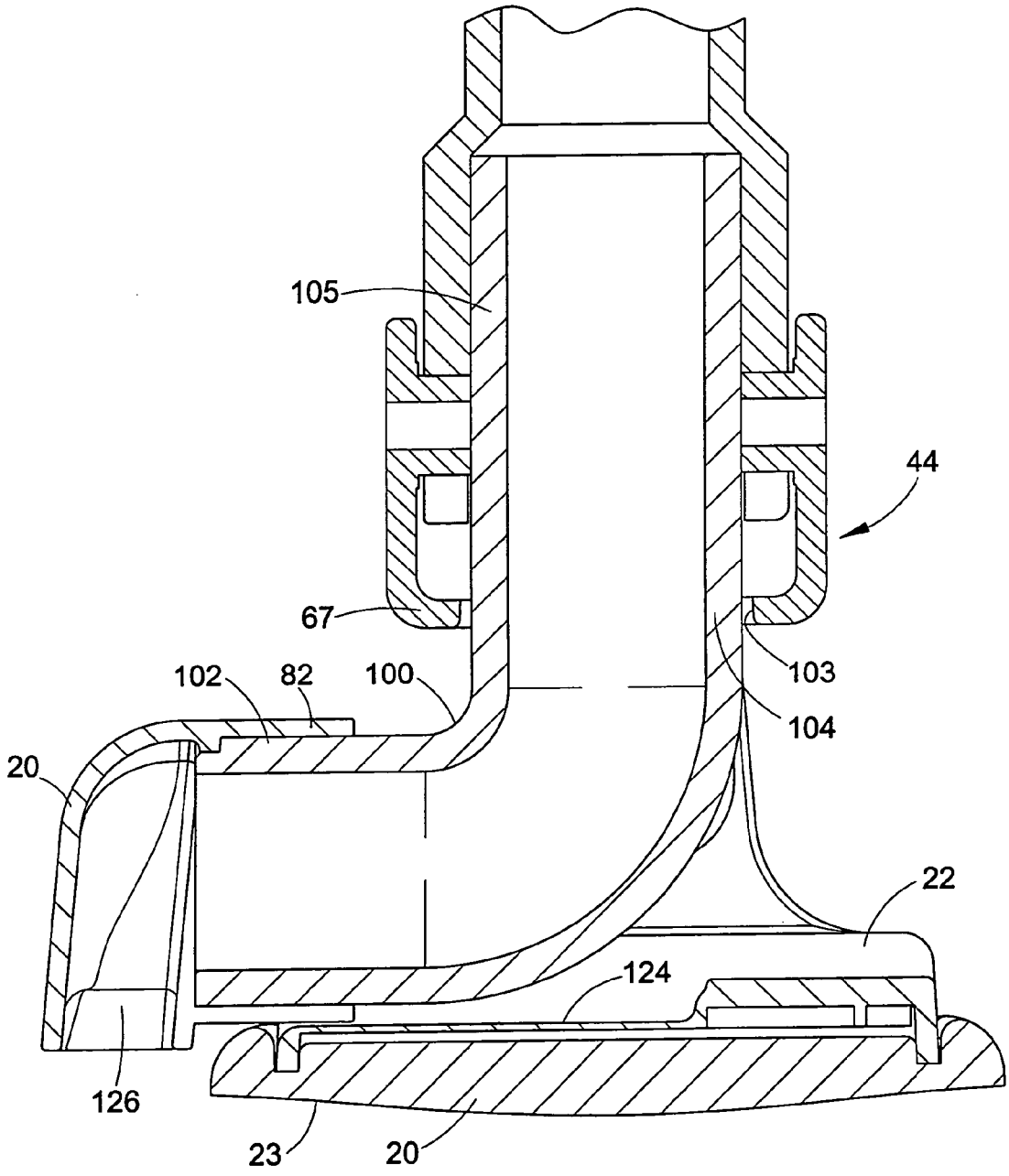
FIG. 5 is an enlarged, assembled side elevational view in cross section of the suction tool of FIG. 3 showing a hose extending through a universal joint.

The support plate includes a top surface 21 to which the clips 52 are attached and a bottom surface 23 (FIG. 5) around which extends the cleaning sheet 30. The bottom surface of the support plate engages at least a portion of the cleaning sheet during use. As shown in FIG. 5, the support plate 22 has a convex shape as is described in detail in published U.S. patent application Ser. No. US2002/0050016 A1, dated May 2, 2002. That document is incorporated herein by reference in its entirety. Referring to FIGS. 3 and 4, a bumper 24 surrounds the outside edge of the support plate. The bumper can be made of foam, rubber, or another elastic or flexible material.

With reference again to FIG. 3, the removable cleaning sheet 30 comprises a scrubbing layer 31. The scrubbing layer 31 is the portion of the cleaning sheet that contacts the soiled surface during cleaning. As such, materials useful as a scrubbing layer must be sufficiently durable that the layer will retain its integrity during the cleaning process. For example, an electrostatic cloth or pad may be used. The sheets can be made of polyester or polypropylene and build a negative charge as they are rubbed over a surface. This is known in the art. Close contact transfers electrons from the dirt to the cleaning sheet, increasing its negative charge. Hair and dust particles are positively charged and are thus attracted to the sheet.

As previously discussed, a problem that exists with cleaning implements employing cleaning sheets is that the cleaning sheets cannot effectively pick up or retain larger debris, such as granular material, larger dirt particles, food crumbs, or pebbles or debris brought in from outdoors, etc. Thus, it would be convenient to have a vacuum source attached to the cleaning implement to vacuum the larger particles that the cleaning sheet cannot effectively pick up.

Thus, in a first embodiment of the present invention, a canister-type vacuum cleaner is used in combination with an attachment in the form of a suction tool having both a floor nozzle and a support plate holding a cleaning sheet. In this embodiment, the dirt collecting receptacle 14 is in the form of a dirt cup. As shown in FIG. 2, the dirt cup is positioned within an opening or cavity 70 of the housing. The dirt cup is secured into place via a latch or other fastening mechanism. The dirt cup can be at least partially transparent and can be fabricated from a thermoplastic material.

Cleaning of the dirt cup entails removal of dirt from the dirt cup by lifting filter assembly 90 (FIG. 1) out of the dirt cup. This also allows cleaning of the filter medium or replacement of the filter assembly or the filter medium.

The filter assembly 90 is removably attached to the dirt cup. The main filter medium membrane 92 can be defined in a hollow, tubular, cylindrical form from a planar, pleated filter membrane.

The operation of this canister vacuum cleaner is described in detail in commonly owned application Ser. No. 09/944,731, filed on Aug. 31, 2001 and published as U.S. Ser. No. 2002/0026775 A1 on Mar. 7, 2002, which is incorporated hereinto in its entirety.

Referring now to FIG. 5, a conduit 100, in the form of a flexible hose in the preferred embodiment, extends between and connects an outlet 82 of the suction nozzle 20 to an inlet 102 of the hose 100. A portion 104 of the hose extends through an aperture 103 in the base plate 67 of the universal joint and a second end 105 thereof connects to the tube 50 (FIG. 2).

Figure 7:
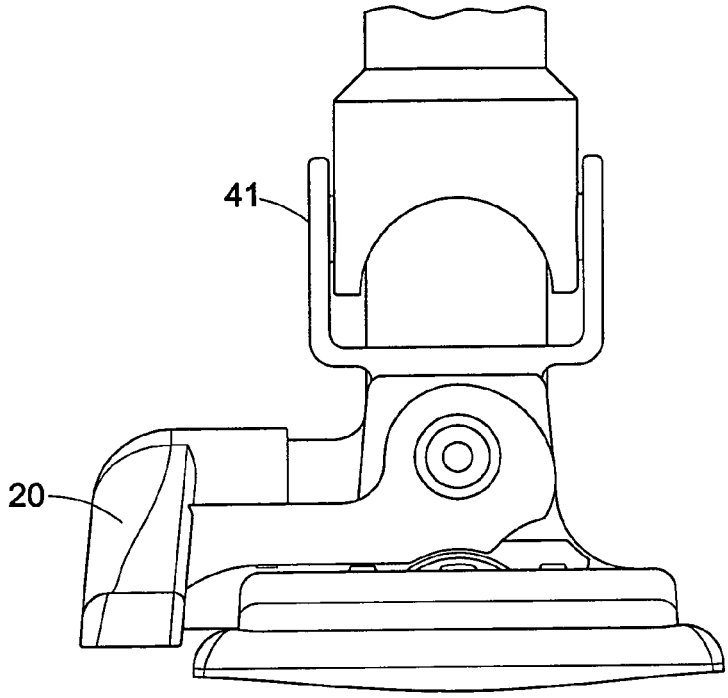
FIG. 7 is a side elevational view of the suction tool of FIG. 1.
Figure 8:
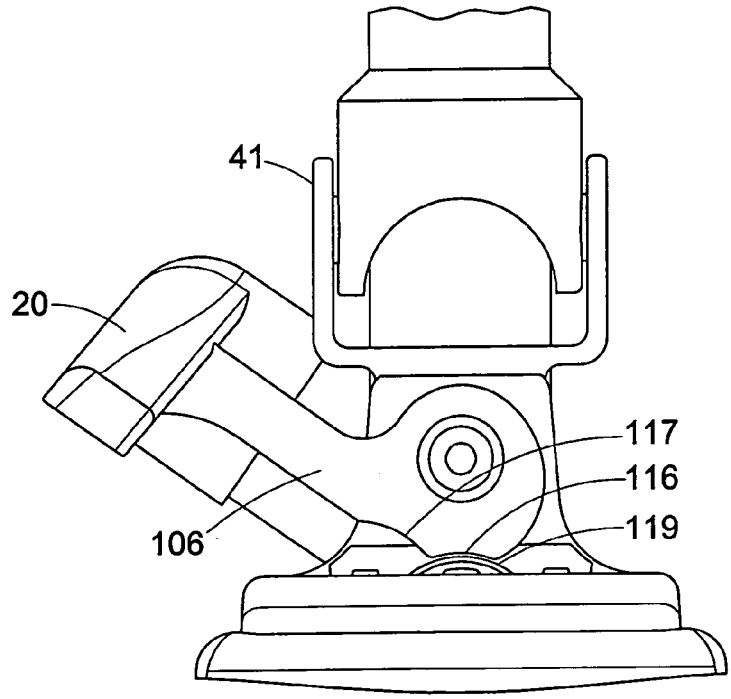
FIG. 8 is a side elevational view of the suction tool of FIG. 7 with a suction nozzle thereof tilted in an upward position to provide access to a cleaning sheet.

Referring again to FIG. 3, the suction nozzle 20 is pivotably connected to the support plate via a pair of spaced apart arms 106, 108 which extend from a rear end 110 of the nozzle. The arms 106, 108 each have a hole 112, 114 respectively through which pins 55 extend to rotatably secure the suction nozzle to the support plate. As best shown in FIG. 8, each of the arms has a pair of adjacent concave sections 116, 117 defined in a lower surface thereof. As best shown in FIG. 3, the sections can each engage or ride upon a resilient detent 119, 120 provided on respective sides of the support plate top surface 21. The detents can snap into respective slots 121, 122 located on the top surface 21 of the support plate. The suction nozzle can be manually pivoted or rotated to one of two positions, a "down" or operating position, shown in FIG. 7 and an "up" or non-operating position, shown in FIG. 8. The sections ride along the detents until the suction nozzle is locked into one of the two positions. In the operating position, the suction nozzle is substantially parallel to the surface to be cleaned for vacuuming. The non-operating position enables the support plate and cleaning sheet to clean a surface without the nozzle interfering with or blocking access to the surface to be cleaned. Also, the sheet 30 can, if dirty, be removed and replaced when the nozzle is in the up position.

With reference again to FIG. 5, the hose 100 is positioned adjacent, and can be seated within, a curved portion 124 of the support plate 22. The hose is also bent or curved to extend from an approximately horizontal orientation adjacent the outlet of the suction nozzle to an approximately vertical orientation adjacent an inlet of the tube. The hose extends through the universal joint assembly as best seen in FIG. 3.

Figure 6:
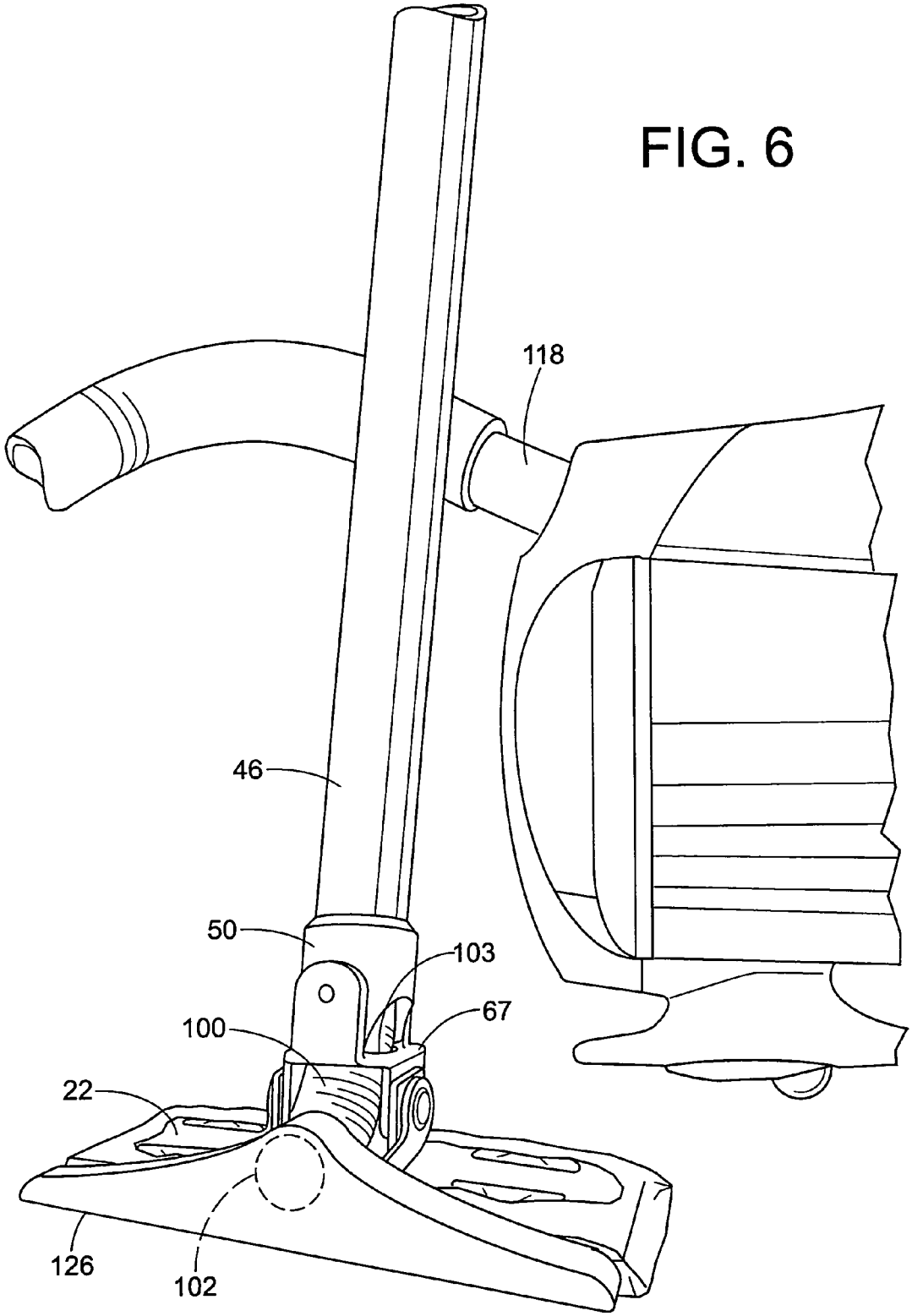
FIG. 6 is an enlarged perspective view of the suction tool of FIG. 1.

Referring again to FIG. 5, when the vacuum cleaner is in use, dirt laden air is drawn in through a suction inlet 126 of the suction nozzle 20 and moves up through the suction nozzle, and out the suction nozzle outlet 82 into the conduit or flexible hose 100. The dirt laden air is then drawn through the hose and into the tube and through wand 46 (FIG. 1) and from there into conduit or flexible hose 32 and then into inlet 118 (FIG. 6) of the housing to the inlet of the dirt cup. The filter medium traps smaller dirt particles that have not been separated out of the dirt laden air stream flowing through the dirt cup. These particles then either fall towards the base wall 127 or are held in or on the filter medium.

Substantially clean air is then drawn into the interior of the filter assembly and passes through a dirt cup outlet via an opening in an end wall of the filter assembly. Once air passes through the outlet and enters the suction fan 12 through a fan inlet, clean air is then blown into the motor chamber, across the motor assembly and out through vents 130 (FIG. 1) defined in the housing. The filter assembly, the exhaust duct of the dirt cup, the fan inlet, and the suction fan and motor assembly can all be aligned along a longitudinal axis to promote efficient air flow. The entire housing 10 can be made from a suitable conventional thermoplastic material if desired.

As mentioned, the power switch 42 is used to selectively actuate the suction fan and motor 12. Power can be provided from a wall outlet by a cord 131 (FIG. 2). Alternatively, a battery pack (not shown) can be used to provide power to the suction fan and motor.

Figure 9A:
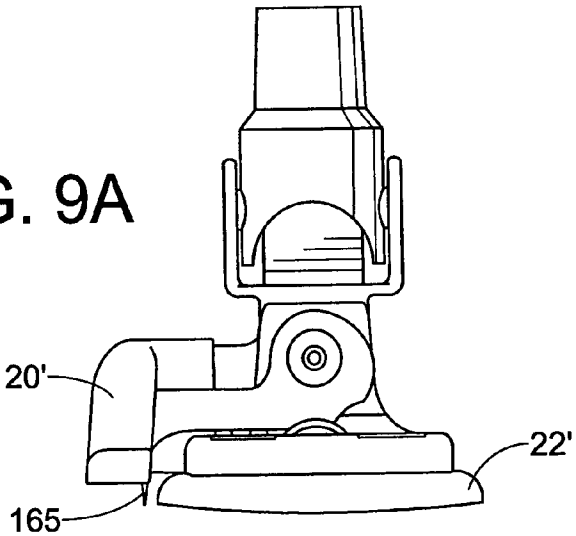
FIG. 9A is a side elevational view of the suction tool of FIG. 9.
Figure 9:
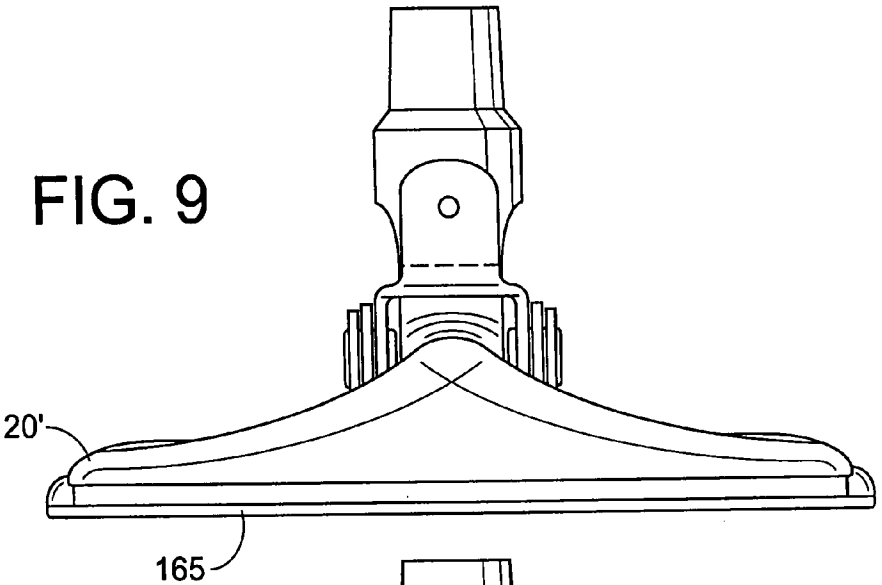
FIG. 9 is an enlarged front elevational view of a suction tool for the vacuum cleaner of FIG. 1 according to a second embodiment of the present invention, including a wiper blade extending from a suction nozzle thereof.

Referring now to FIGS. 9 and 9A, another embodiment of the cleaning attachment according to the present invention is there illustrated. For ease of appreciation of this embodiment, like components are identified by like numerals with a primed (') suffix and new components are identified by new numerals. A suction nozzle 20' can include a wiper blade 165, which extends along a length of the suction nozzle behind a suction opening thereof, for wiping the surface to be cleaned of liquids or solid particles disposed on the surface. The blade 165 also protects a cleaning sheet (not shown) which is attached to a support plate 22', by blocking larger particles of debris from contacting the cleaning sheet, thus preventing abrasions or tearing of the cleaning sheet.

Figure 10A:
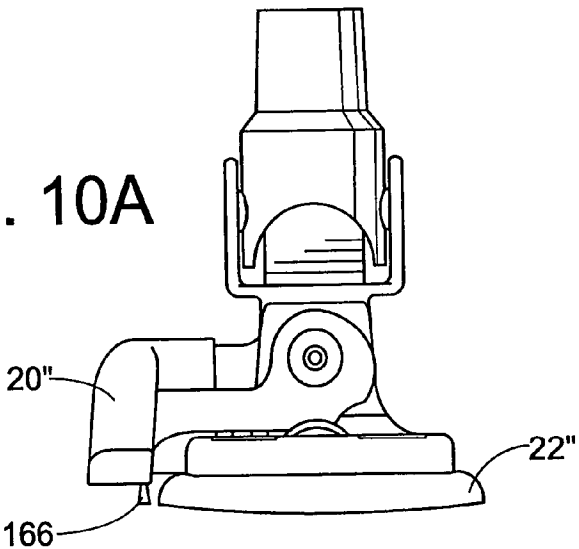
FIG. 10A is a side elevational view of the suction tool of FIG. 10.
Figure 10:
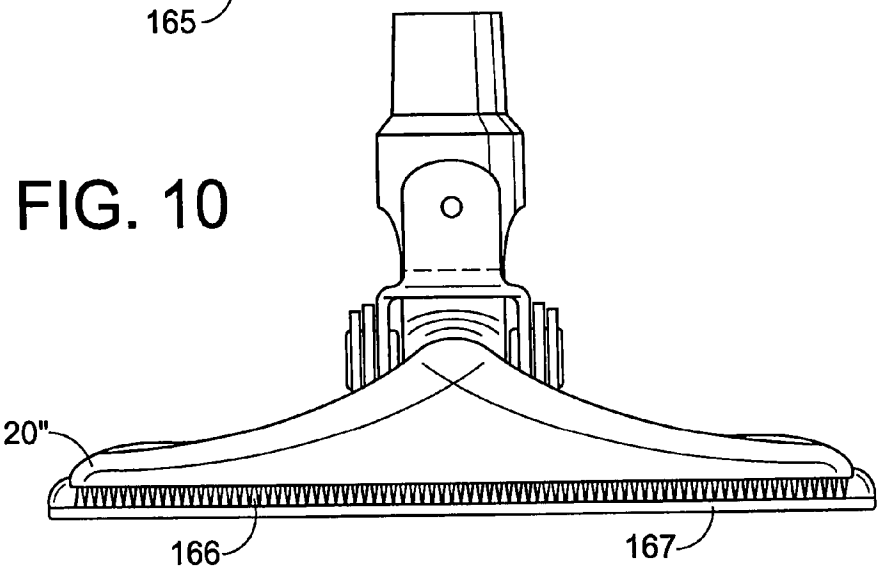
FIG. 10 is an enlarged front elevational view of a suction tool for the vacuum cleaner of FIG. 1 according to a third embodiment of the present invention, including a row of bristle tufts extending from a suction nozzle thereof.

With reference now to FIGS. 10 and 10A, yet another embodiment of the cleaning attachment according to the present invention is there illustrated. For ease of appreciation of this embodiment, like components are identified by like numerals with a double primed (") suffix and new components are identified by new numerals. A suction nozzle 20" can include a bristle tuft assembly 166 having a series of tufts 167 extending along a length of the suction nozzle. The tufts help sweep particles of debris from the surface to be cleaned and prevent debris from contacting a cleaning sheet (not shown) attached to a support plate 22" which could cause damage to the cleaning sheet, such as abrasions or tearing.

Figure 11:
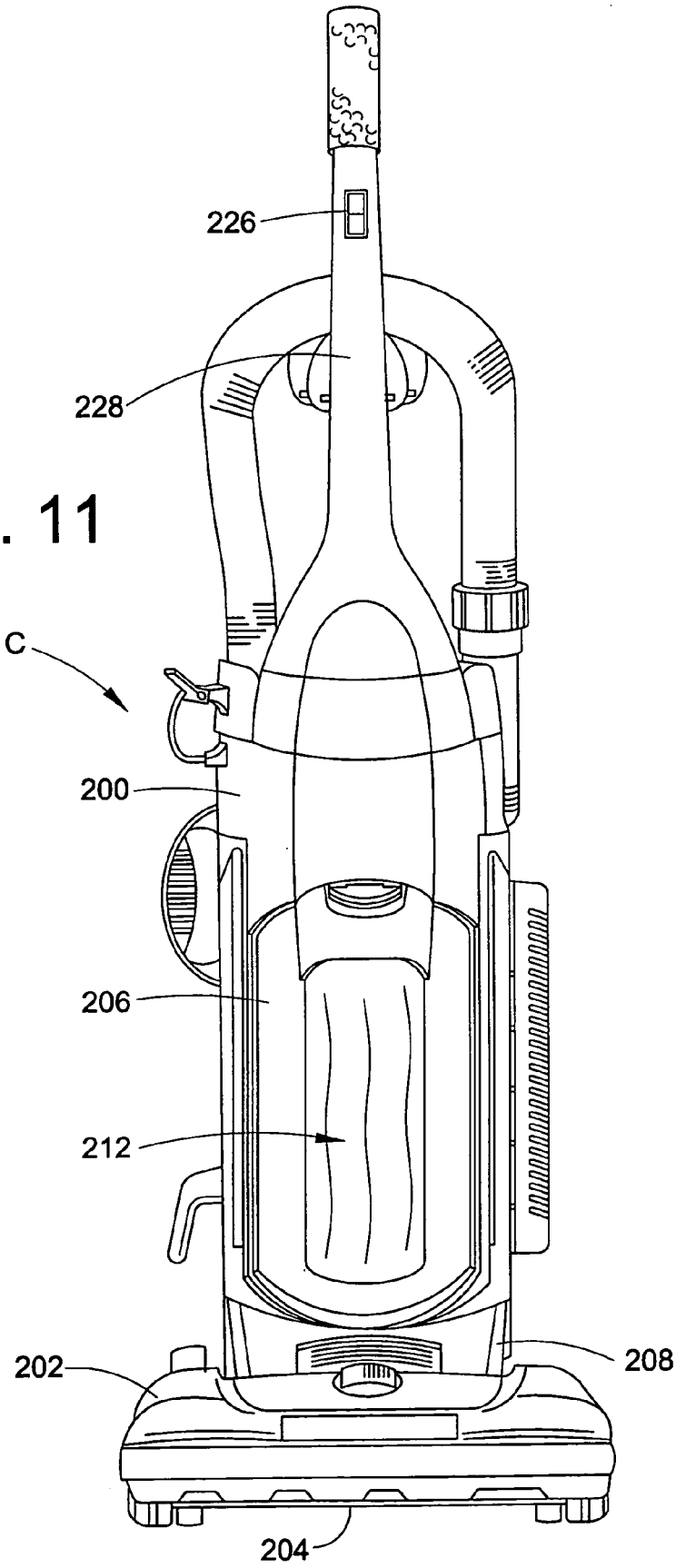
FIG. 11 is a front elevational view of an upright cleaner according to another embodiment of the present invention.

According to yet another embodiment of the present invention, referring to FIG. 11, the cleaning tool or attachment of the present invention can also be used with an upright vacuum cleaner C. As is known, an upright vacuum cleaner includes an upright housing 200 and a nozzle base 202 hingedly interconnected with the upright housing. The nozzle base includes a main suction opening 204 in its underside. A filter chamber 206 is defined in the upright housing and is adapted for separating dust and dirt from a suction air stream. The main suction opening 204 is in fluid communication with the filter chamber. A suction source 208 is located in the upright housing and has a suction airflow inlet in fluid communication with the filter chamber, and also includes a suction airflow outlet. A main filter assembly 212 is located in the filter chamber upstream from the suction source for filtering dust and dirt from a suction air stream that passes through the airflow chamber. The internal configuration of an upright vacuum cleaner of this type is described in U.S. Pat. No. 6,463,622 which is hereby incorporated by reference in its entirety.

While the upright vacuum cleaner is shown to be of the type that employs a dust cup and a filter element, it should be appreciated that the cleaning tool or attachment of the present invention could also be used with upright vacuum cleaners that employ filter bags. In addition, while the canister vacuum cleaner illustrated in FIGS. 1, 2 and 6 employs a dust cup and a filter, it should be evident that the cleaning tool or attachment of the present invention could also be used with canister vacuum cleaners that employ filter bags.

A switch 226 is provided on a handle 228 of the upright vacuum cleaner for selectively powering the motor/fan assembly. A valve or switch is provided for directing the suction through either the nozzle of the vacuum cleaner or through a cleaning attachment in the form of a suction tool according to the present invention.

Figure 12:
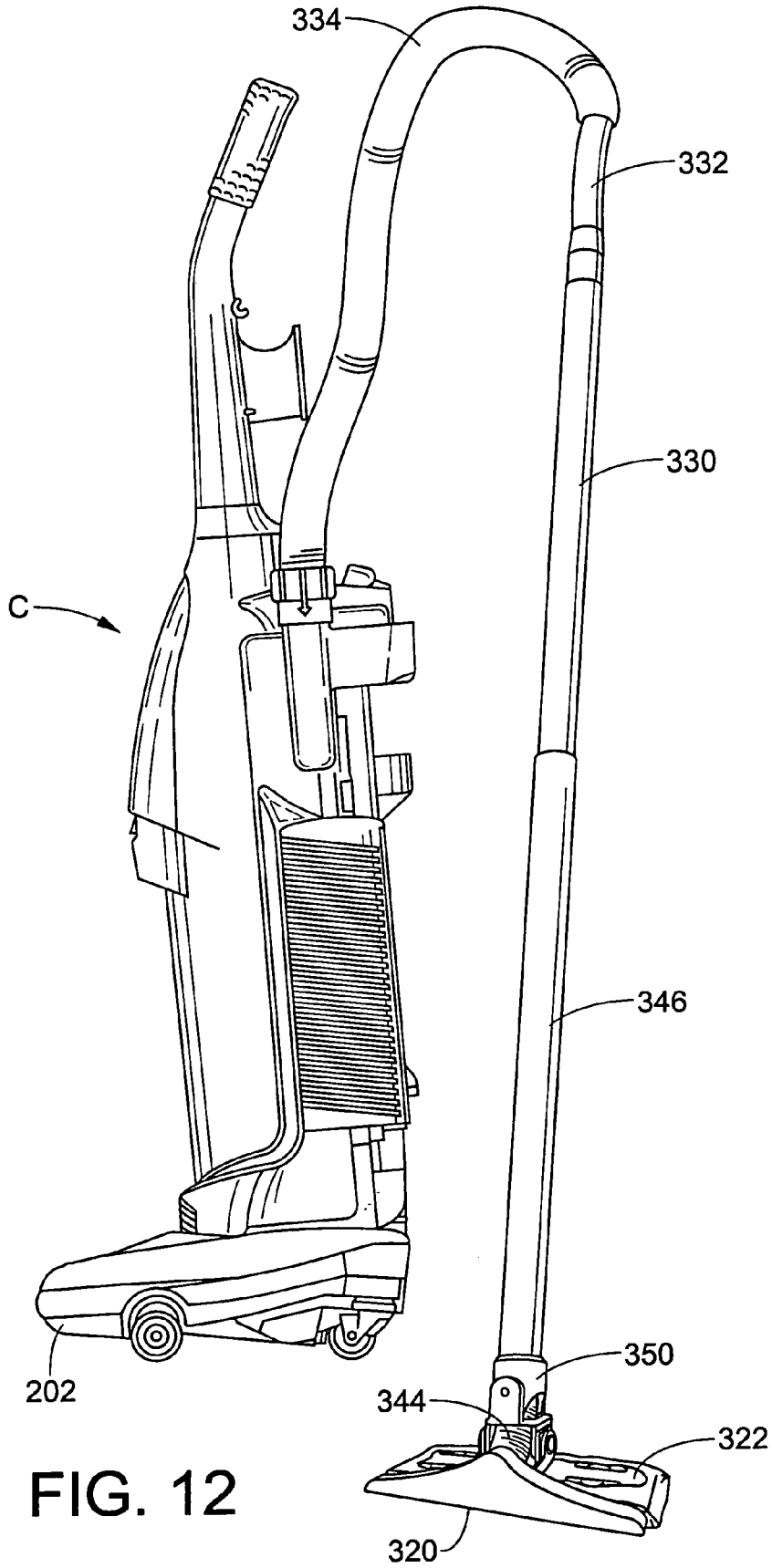
FIG. 12 is a perspective view of the upright vacuum cleaner of FIG. 11 with an attachment or suction tool according to another embodiment of the present invention, connected thereto.

Referring to FIG. 12, the suction tool can be of the type described in FIGS. 1-10. Therefore the suction tool includes a suction nozzle 320 pivotally attached to a support plate 322 that holds a cleaning sheet. A universal joint 344 connects the suction nozzle and cleaning sheet holder to a pipe 350 which in turn connects to a wand 346. Additional extensions 330, 332 to the wand can be provided. A conduit 334, in the form of a flexible hose is attached to the wand and communicates with an inlet of the filter chamber.

In addition to canister and upright vacuum cleaners, the suction tool or attachment of the present invention could also be used with other known types of indoor household cleaning appliances that employ suction, such as wet/dry vacuum cleaners and carpet extractors. Also, the suction tool or attachment of the present invention can be readily used with known central vacuum cleaner systems.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An attachment for use with a vacuum cleaner, comprising:
- a suction nozzle;
- a conduit communicating said nozzle with said vacuum cleaner;
- a support plate;
- a pivot joint connecting said support plate to said suction nozzle, wherein said support plate and said suction nozzle are pivotable in relation to each other; and,
- a cleaning sheet selectively attached to said support plate for collecting dust and dirt to be cleaned.

2. An attachment, for use with a vacuum cleaner, comprising:
- a suction nozzle;
- a conduit communicating said nozzle with said vacuum cleaner, wherein said conduit comprises a flexible hose;
- a support plate;
- a pivot joint connecting said support plate to said suction nozzle; and,
- a cleaning sheet selectively attached to said support plate for collecting dust and dirt to be cleaned.

3. The attachment of claim 1, wherein said cleaning sheet comprises an electrostatic material.

4. The attachment of claim 1, wherein said support plate comprises a convex surface.

5. The attachment of claim 1, wherein said support plate comprises a top surface having at least one clip for securing said cleaning sheet to said support plate.

6. The attachment of claim 1, further comprising a wand connected between said conduit and said suction nozzle.

7. The attachment of claim 1, further comprising a wiper blade mounted to said nozzle.

8. The attachment of claim 1, further comprising a plurality of bristles mounted to said nozzle.

9. The attachment of claim 1, wherein said suction nozzle is secured to said support plate via cooperating extension portions of each that are connected together.

10. The attachment of claim 9, further comprising fasteners for connecting said cooperating extension portions together.

11. A vacuum cleaner having an attachment, comprising:
- a housing;
- a suction fan and motor mounted to said housing;
- a dirt collecting receptacle mounted to said housing in spaced relationship to said suction fan and motor;
- an attachment comprising:
  - a suction nozzle;
  - a support plate connected to said suction nozzle, said support plate selectively holding a cleaning sheet for collecting dust and debris from a surface to be cleaned; and,
- a flexible conduit communicating said suction nozzle with said housing.

12. The vacuum cleaner of claim 11, wherein said dirt collecting receptacle comprises a dirt cup.

13. The vacuum cleaner of claim 12, further comprising a filter detachably mounted to said dirt cup.

14. The vacuum cleaner of claim 13, wherein said dirt cup comprises an inlet and an outlet, wherein said inlet communicates with an outlet of said suction nozzle and said dirt cup outlet communicates with an inlet of said suction fan and motor assembly.

15. The vacuum cleaner of claim 11, further comprising a pivot joint connecting said support plate to said suction nozzle.

16. The attachment of claim 11, wherein said conduit comprises a flexible hose.

17. The attachment of claim 11, wherein said cleaning sheet comprises an electrostatic material.

18. The attachment of claim 11, wherein said support plate comprises a convex surface.

19. The attachment of claim 11, wherein said support plate comprises a top surface having at least one clip for securing said cleaning pad to said support plate.

20. The attachment of claim 15, further comprising a wand extending from said pivot joint.

21. The attachment of claim 11, wherein said suction nozzle is secured to said support plate via cooperating extensions portions of each.

22. The attachment of claim 21, wherein said suction nozzle is pivotally mounted on said support plate.

23. The vacuum cleaner of claim 11, wherein said support plate is pivotally connected to said housing via a universal joint.

24. An attachment for use with a vacuum cleaner, comprising:

a suction nozzle;

a conduit comprising a first end and a second end, wherein said conduit first end is connected to said suction nozzle and said conduit second end is connected to a filter chamber in an associated vacuum cleaner;

a support plate positioned rearwardly of said suction nozzle;

a pivot joint connecting said support plate to said suction nozzle; and a cleaning sheet removably attached to said support plate for collecting dust and dirt from a surface to be cleaned.

25. The attachment of claim 24, further comprising a clip for selectively attaching said cleaning sheet to said support plate.

26. The attachment of claim 24, wherein said cleaning sheet comprises an electrostatic material.

27. The attachment of claim 24, wherein said conduit comprises a flexible hose.

28. The attachment of claim 24, wherein said pivot joint securing said suction nozzle to said support plate comprises cooperating extension portions secured to each other by at least one fastener.

29. The attachment of claim 24, further comprising a wand connected between said conduit and said suction nozzle.

* * * * *